US008033659B2

(12) United States Patent
Kobayashi

(10) Patent No.: US 8,033,659 B2
(45) Date of Patent: Oct. 11, 2011

(54) LIQUID EJECTING APPARATUS

(75) Inventor: Atsushi Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 931 days.

(21) Appl. No.: 11/959,771

(22) Filed: Dec. 19, 2007

(65) Prior Publication Data

US 2008/0151026 A1 Jun. 26, 2008

(30) Foreign Application Priority Data

Dec. 19, 2006 (JP) ..... 2006-341427
Nov. 29, 2007 (JP) ..... 2007-308187

(51) Int. Cl.
*B41J 2/19* (2006.01)

(52) U.S. Cl. ..... 347/92; 347/93

(58) Field of Classification Search ..... 347/92, 347/93

See application file for complete search history.

(56) References Cited

U.S. PATENT DOCUMENTS 6,457,820 B1 * 10/2002 Cai et al. ..... 347/92
6,557,990 B2 * 5/2003 Altendorf ..... 347/92
2003/0043244 A1 * 3/2003 Kaga et al. ..... 347/87
2005/0157130 A1 * 7/2005 Inoue ..... 347/92
2005/0264624 A1 * 12/2005 Ogura et al. ..... 347/86

FOREIGN PATENT DOCUMENTS

JP 2005-219229 A 8/2005
JP 2005-238163 A 9/2005
JP 2006-27051 A 2/2006
JP 2006-75683 A 3/2006
JP 2006-95878 * 4/2006
JP 2006-95878 A 4/2006
JP 2006-327097 A 12/2006

* cited by examiner

*Primary Examiner* — Charlie Peng
(74) *Attorney, Agent, or Firm* — Sughrue Mion, PLLC

(57) ABSTRACT

A liquid ejecting head has a pressure chamber into which liquid flows from a liquid reservoir through a liquid passage, and a pressure generating unit operable to pressurize the liquid in the pressure chamber to eject the liquid through a nozzle opening. A gas trapping chamber is formed in the liquid passage and adapted to trap gas mixed in the liquid. A gas collecting chamber is formed adjacent to the gas trapping chamber. A gas permeable wall is interposed between the gas trapping chamber and the gas collecting chamber. A pressure difference generating unit is operable to generate a pressure difference between the gas trapping chamber and the gas collecting chamber so that a pressure in the gas collecting chamber is lower than a pressure in the gas trapping chamber, thereby collecting the gas trapped in the gas trapping chamber in the gas collecting chamber through the gas permeable wall.

2 Claims, 7 Drawing Sheets

LIQUID EJECTING APPARATUS

The disclosures of Japanese Patent Application No. 2006-341427 filed on Dec. 19, 2006 and Japanese Patent Application No. 2007-308187 filed on Nov. 29, 2007 including specifications, drawings and claims are incorporated herein by reference in its entireties.

BACKGROUND

The present invention relates to a liquid ejecting apparatus such as an ink jet printer, and more particularly, to a liquid ejecting apparatus having a liquid ejecting head that introduces liquid reserved in a liquid reservoir into a pressure chamber through a liquid passage and that ejects the liquid introduced into the pressure chamber as droplets.

A representative example of a liquid ejecting apparatus having a liquid ejecting head that can eject liquid and ejecting various kinds of liquid from the liquid ejecting head can include an image forming apparatus such as an ink jet printer that performs a printing operation by ejecting and landing ink droplets onto a printing sheet as an ejection target (printing medium). In recent years, the liquid ejecting apparatus was not limited to the image forming apparatus, but was applied to various manufacturing apparatuses. In apparatuses for manufacturing displays such as liquid crystal displays, plasma displays, organic EL (electroluminescence) displays, and FEDs (surface emission displays), the liquid ejecting apparatus was used to eject color materials or various liquid materials for electrodes and the like to pixel forming areas or electrode forming areas.

A liquid ejecting apparatus that has a carriage mounted with the liquid ejecting head and a liquid reservoir (liquid source) and that ejects liquid in the liquid reservoir as droplets from the liquid ejecting head while moving the carriage was known (on-carriage type).

For example, like a business printer for performing a printing operation on a printing sheet having a large size, in a liquid ejecting apparatus using a relatively large amount of liquid once, a configuration in which a liquid source (ink cartridge) as a liquid reservoir is disposed in an apparatus body, a relay unit (ink pressure control unit which serves as a pressure control valve for controlling a pressure change at the time of supplying ink) for introducing ink from the liquid source into the liquid ejecting head is fitted to the liquid ejecting head, the liquid source and the relay unit are connected to each other through a flexible liquid supply tube, and ink is supplied from the liquid source to the liquid ejecting head through the liquid supply tube is employed (off-carriage type) (Patent Document 1).

In the configuration employing the ink cartridge representative of the liquid source, it is ideal that an ink passage (liquid passage) from an ink introduction needle inserted into the ink cartridge to a nozzle opening of a print head is filled with ink, but gas may permeate the ink passage due to replacement of the ink cartridge or the like, which it is difficult to completely prevent. Specifically, in an off-carriage type in which ink is supplied to the liquid ejecting head through a liquid supply tube from the ink cartridge, external air may permeate the wall surface of the liquid supply tube and may be melted in the ink, thereby saturating the ink in the ink passage. Accordingly, gas newly permeating the ink passage may be not melted in the ink, or the melted gas may get bubbles due to a change in temperature and may be mixed into the ink in the ink passage. The bubbles entering the ink passage in this way becomes greater gradually and when excessively grown bubbles moves to the pressure chamber by means of a flow of ink, pressure loss due to the bubbles absorbing pressure change at the time of performing an ejecting operation or lack in ink supply due to the bubbles' blocking the passage may be caused.

In order to prevent the problem with the mixture of bubbles, the liquid ejecting head is made to periodically perform a cleaning operation of generating a flow of ink at a flow rate greater by several times than that at the time of performing a printing operation, thereby discharging the bubbles in the ink passage. As a configuration for discharging the gas mixed into the ink other than the cleaning operation, a configuration in which a gas permeable film is disposed on a side surface of a common liquid chamber communicating with the pressure chamber, a chamber is disposed opposite a side of the gas permeable film contacting liquid, and the liquid in the common liquid chamber is degassed by generating a negative pressure in the chamber to prevent bubbles form being generated in the pressure chamber has been suggested (Patent Document 2).

Patent Document 1: Japanese Patent Publication No. 2005-219229A

Patent Document 2: Japanese Patent Publication No. 2006-95878A

However, in the configuration disclosed in the Patent Document 2, when a pressure difference between the common liquid chamber and the chamber is not great (for example, at least 50 kPa or more at the room temperature and preferably in the range of 80 kPa to 100 kPa), the gas in the common liquid chamber cannot permeate the gas permeable film to degas ink, thereby requiring a large-sized depressurizing means. In addition, when the pressure difference is too great, steam mixed in the ink gets out and the ink in the ink passage increases in viscosity. Accordingly, it is necessary to control the pressure in the chamber while monitoring the pressure with a pressure gauge. The gas permeable film formed of a fluorine-based film or a silicon-based film decreases in permeability due to permeation of the ink. When the ink is not sufficiently degassed in the common liquid chamber and bubbles are abruptly mixed into the ink passage due to attachment and detachment of the ink cartridge, the bubbles may enter the adjacent pressure chamber to cause a problem before the bubbles are melted in the ink.

The gas permeable film may not endure the pressure and be destroyed when the pressure difference increases, or the gas permeable film may be warped due to the pressure change and thus the ink may be carelessly ejected from the nozzle openings of the liquid ejecting head. The gas permeable film may absorb the pressure change at the time of ejecting the ink from the nozzle openings of the liquid ejecting head to cause the pressure loss, thereby badly influencing the ejection characteristic, such as a decrease in amount or rate of the ink ejected.

When it is intended to employ the gas permeable film, a film attaching process is necessary, thereby deteriorating the manufacturing efficiency. Since the rigidity of the film portion is small, supporting pillars (supporting members) for reinforcing the peripheral portion thereof are necessary. The provision of the supporting pillars may cause an increase in passage resistance of the passage, thereby badly influencing the ejection frequency and the like. In order to dispose the supporting pillars, it is necessary to consider the balance among the degassing efficiency, the head rigidity, and the passage resistance of the common liquid chamber, thereby making the design thereof difficult.

SUMMARY

The invention is contrived in view of the above-mentioned situations. An object of the invention is to provide a liquid ejecting apparatus which can prevent problems resulting from mixture of gas in advance by trapping and collecting the gas mixed into a liquid passage without performing a cleaning operation.

In order to achieve the above object, according to an aspect of the invention, there is provided a liquid ejecting apparatus including a liquid ejecting head which has a pressure chamber into which liquid flows from a liquid reservoir through a liquid passage, and a pressure generating unit operable to pressurize the liquid in the pressure chamber to eject the liquid through a nozzle opening, the liquid ejecting apparatus comprising: a gas trapping chamber formed in the liquid passage and adapted to trap gas mixed in the liquid; a gas collecting chamber formed adjacent to the gas trapping chamber; a gas permeable wall interposed between the gas trapping chamber and the gas collecting chamber; and a pressure difference generating unit operable to generate a pressure difference between the gas trapping chamber and the gas collecting chamber so that a pressure in the gas collecting chamber is lower than a pressure in the gas trapping chamber, thereby collecting the gas trapped in the gas trapping chamber in the gas collecting chamber through the gas permeable wall.

According to the above-mentioned configuration, it is possible to trap the gas mixed into the liquid passage in the gas trapping chamber and to collect the trapped gas in the gas collecting chamber. Accordingly, it is possible to prevent the problems due to the bubbles' entering the pressure chamber as sufficiently as possible. since the number of times for performing the cleaning operation of discharging the bubbles can be reduced, it is possible to reduce the consumption of ink accompanied with the cleaning operation.

The gas permeable wall may have rigidity so that the gas permeable wall maintains the shape thereof when being subjected to the pressure difference. The gas permeable wall may be a part of a structure forming the liquid passage.

According to the above-mentioned configuration, it is possible to suppress the deformation or damage of the gas permeable wall and the permeation of liquid when the pressure difference is generated by the pressure difference generating unit. It is possible to prevent the careless ejection of liquid due to the warping of the gas permeable wall with the pressure change by means of the pressure difference generating unit. It is also possible to suppress the pressure loss at the time of ejecting the liquid from the nozzle openings of the liquid ejecting head.

A gas permeability of the structure may be higher than a gas permeability of another structure forming the liquid passage.

According to the above-mentioned configuration, it is possible to satisfactorily enhance the air-tightness of the other partition wall while securing the gas permeability of the gas permeable wall. Accordingly, it is possible to efficiently remove the gas from the gas trapping chamber.

The gas permeable wall is monolithically integrated with the structure forming the liquid passage. The liquid passage may be defined by a partition wall in the structure, a part of which is exposed to ambient air. A thickness of the gas permeable wall may be thinner than a thickness of the exposed part of the partition wall.

According to the above-mentioned configuration, since the permeable partition wall is monolithically integrated with the structure partitioning the liquid passage, it is possible to omit the process of particularly forming and attaching the gas permeable wall and to enhance the gas permeability.

The pressure difference may be set to a saturated vapor pressure in a surrounding temperature of the gas trapping chamber or more.

The pressure difference may be higher than 0 kPa, and equal to or lower than 30 kPa.

The liquid ejecting apparatus may further comprise a pressure difference maintaining unit operable to maintain the pressure difference during the liquid ejecting apparatus is deactivated.

According to the above-mentioned configuration, it is possible to maintain the pressure difference for a long time. Accordingly, even when the pressure difference is not greater than that in the past, it is possible to slowly collect the bubbles in the gas trapping chamber for a long time. Accordingly, it is possible to satisfactorily suppress the deformation of the gas permeable wall or the permeation of liquid resulting from the increase in pressure difference. Therefore, it is possible to prevent the problems such as a decrease in gas permeability due to the permeation of ink in advance.

The pressure difference generating unit may be operable to increase the pressure in the gas trapping chamber higher than an air pressure and the pressure in the gas collecting chamber.

The pressure difference generating unit may be operable to decrease the pressure in the gas collecting chamber lower than the pressure in the gas trapping chamber.

The liquid ejecting apparatus may further comprise: a sealing member adapted to seal the nozzle opening of the liquid ejecting head; and a suction pump connected to the sealing member through a first suction passage and operable to depressurize the nozzle opening, wherein the pressure difference generating unit includes a second suction passage connecting the gas collecting chamber to the first suction passage.

According to the above-mentioned configuration, it is possible to generally depressurize the gas collecting chamber by the use of the suction pump used in the cleaning operation. Accordingly, it is not necessary to provide the depressurizing means as an additional pressure difference generating unit. Since the gas collecting chamber can be depressurized by mans of the suction accompanied with the cleaning operation, an additional suction operation may be not be performed only for depressurizing the gas collecting chamber.

A volume decrease rate of the gas trapped in the gas trapping chamber due to the collection of the gas in the gas collecting chamber may be larger than a volume increase rate of the gas trapped in the gas trapping chamber due to the trapping of the gas mixed in the liquid.

According to this configuration, it is possible to prevent the gas in the gas trapping chamber from increasing to the volume enough to cause a problem in the apparatus, thereby reducing the possibility of mixing the bubbles into the pressure chamber. Therefore, it is possible to prevent a problem from occurring in the apparatus due to the mixture of gas into the pressure chamber.

The liquid ejecting apparatus may further comprise: a filter chamber formed in the liquid passage; and a filter provided in the filter chamber and operable to filter the liquid flowing through the liquid passage, wherein a space located upstream of the filter in a liquid flowing direction in the filter chamber serves as the gas trapping chamber.

According to this configuration, it is not necessary to additionally provide a gas trapping chamber for trapping gas in the liquid passage.

The gas trapping chamber may be formed in the liquid passage in the liquid ejecting head.

According to this configuration, it is possible to satisfactorily trap and collect the gas in the liquid passage in the vicinity of the pressure chamber, thereby reducing the possibility of mixing the gas into the pressure chamber.

A part of the liquid passage located upstream of the gas trapping chamber in a liquid flowing direction and a part of the liquid passage located downstream of the gas trapping chamber in the liquid flowing direction may be located under the gas trapping chamber in a vertical direction.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, exemplary embodiments of the invention will be described with reference to the drawings. In the following embodiments, various limitations are made as specific aspects of the invention, but the invention is not limited to the aspects so long as an intention to limit the invention is not described in the following description. In the embodiments, an ink jet printer (hereinafter, simply referred to as printer) representative of an image recording apparatus as an example of a liquid ejecting apparatus is exemplified.

Figure 1:
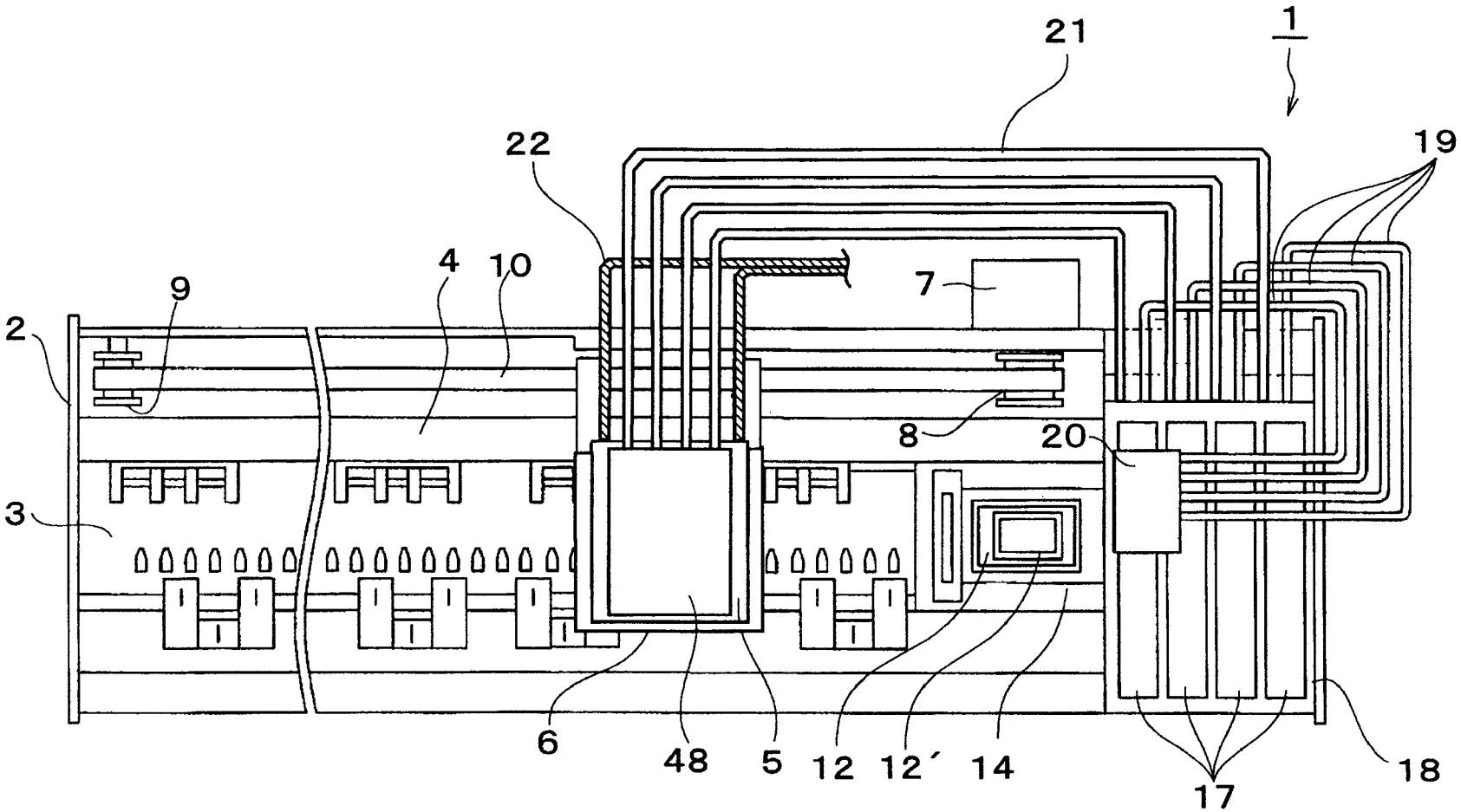
FIG. 1 is a plan view illustrating a configuration of a printer which is mounted with a print head according to an embodiment of the invention.

As shown in FIG. 1, a printer 1 includes a chassis 2 and a platen 3 disposed in the chassis 2. A printing sheet (printing medium or a kind of ejection target (not shown)) is transported over the platen 3 by sheet transporting rollers (all of which are not shown) rotating by means of the driving of a sheet transfer motor. In the chassis 2, a guide rod 4 is suspended parallel to the platen 3. A carriage 6 mounted with a print head 5 is slidably supported by the guide rod 4. The carriage 6 is connected to a timing belt 10 suspended between a driving pulley 8 rotating by means of the driving of a pulse motor 7 and an idle pulley 9 disposed on a side of the chassis 2 opposite to the driving pulley 8. The carriage 6 is configured to reciprocate along the guide rod 4 in a main scanning direction perpendicular to a sheet transfer direction by driving the pulse motor 7.

A capping mechanism 12 is disposed at a home position which is a non-printing area (non-ejection range) of the printer 1. The capping mechanism 12 has a cap member 12' of a tray shape (an example of a sealing member in the invention) which can come in contact with a nozzle forming surface of the print head 5. In the capping mechanism 12, a space in the cap member 12' serves as a sealed space and is configured to come in dose contact with the nozzle forming surface in a state where the nozzle openings 13 (see FIG. 3) of the print head 5 face the sealed space. A pump unit 14 including a suction pump is connected to the capping mechanism 12 and the sealed space can be made to have a negative pressure by means of the activation of the pump unit 14. When the pump unit 14 is activated in a state where it is in dose contact with the nozzle forming surface to make the sealed space (airtight space) have a negative pressure, the ink in the print head 5 is sucked by the nozzle openings 13 and is discharged into the sealed space of the cap member 12'. That is, the capping mechanism 12 performs a cleaning operation of generating a flow of ink at a flow rate greater by several times than that of the printing operation in the print head 5 (in the ink passage) and forcibly sucking and discharging the ink or bubbles.

One side of the chassis 2 adjacent to the home position is provided with a cartridge holder 18 which is detachably mounted with ink cartridges 17. In this embodiment, 4 ink cartridges 17 in total (examples of the liquid reservoir in the invention) are mounted on the cartridge holder 18. The ink cartridges 17 are connected to an air pump 20 through air tubes 19 and air is supplied to the ink cartridges 17 from the air pump 20. By pressurizing the ink cartridges 17 by the use of the air, the ink is supplied (fed) to the print head 5 through ink supply tubes 21 (an example of a member forming the liquid passage in the invention).

The ink supply tubes 21 are flexible hollow members and are formed to correspond to the ink cartridges 17 (colors), respectively. An FFC (Flexible Flat Cable) 22 for transmitting a driving signal to the print head 5 from a controller of the body of the printer 1 is disposed between the body of the printer 1 and the print head 5.

Next, the print head mounted on the printer 1 will be described.

Figure 2:
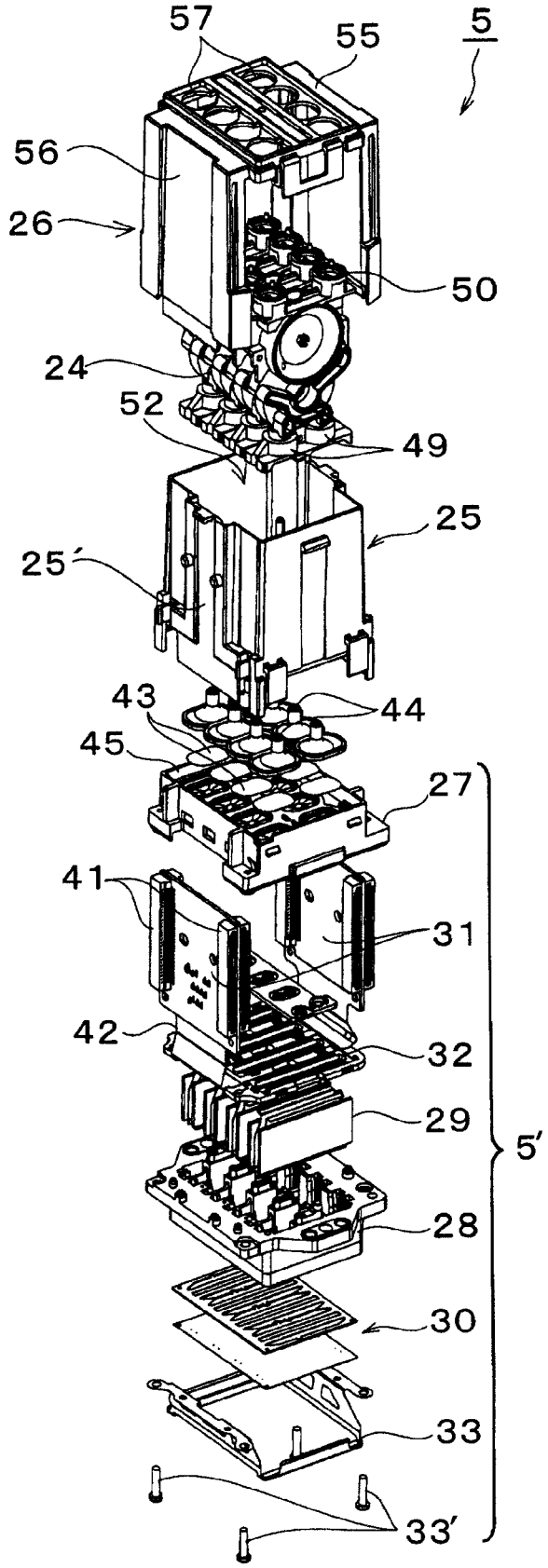
FIG. 2 is an exploded perspective view illustrating the print head.

As shown in FIG. 2, the print head 5 in this embodiment includes a head body 5', an ink pressure control unit 24, a first case 25, and a second case 26 as major elements. The head body 5' includes an introduction needle unit 27, a head case 28, a vibrator unit 29, a passage unit 30, a driving board 31, a relay board 32, and a head cover 33.

Figure 3:
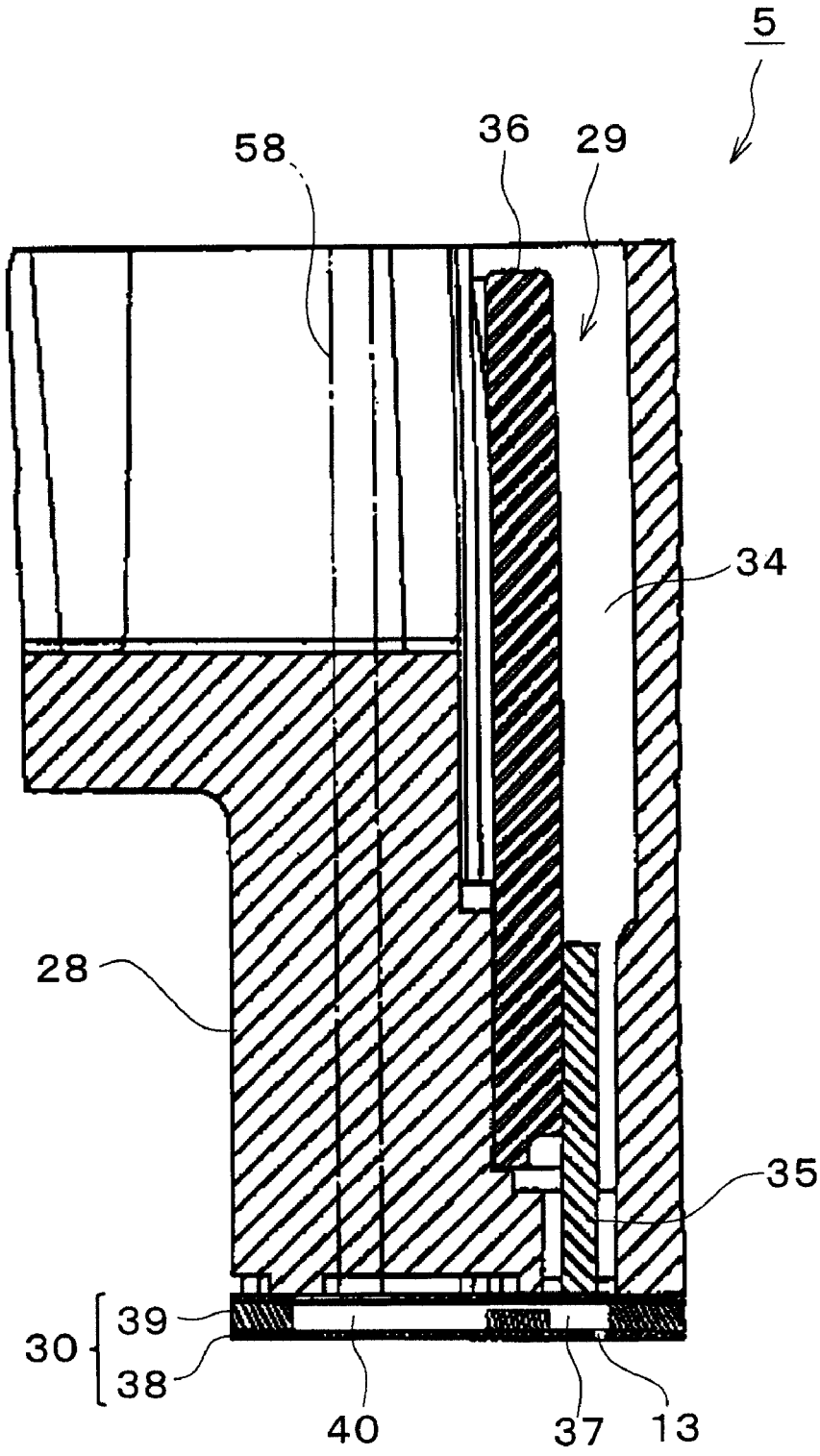
FIG. 3 is a sectional view illustrating a head body of the print head.

The head case 28 is a hollow member having a box shape. As shown in FIG. 3, the passage unit 30 is fixed to the end surface (bottom surface) thereof, the vibrator unit 29 is received in a fixing member 34 formed therein, and the relay board 32 and the introduction needle unit 27 are disposed on the base end surface (top surface) opposite to the passage unit 30. The vibrator unit 29 includes plural piezoelectric vibrators 35 (an example of the pressure generating unit in the invention) arranged in a comb shape, a wiring member (not shown) for supplying a driving signal to the piezoelectric vibrators 35, and a fixing plate 36 for fixing the piezoelectric vibrators 35. The piezoelectric vibrators 35 are bonded to a flexible surface (vibrating plate) for partitioning the pressure chamber 37 in the passage unit 30. The piezoelectric vibrators 35 are flexibly activated with the supply of the driving signal to expand or contract the volume of the pressure chamber 37, thereby causing pressure change in the ink in the pressure chamber 37. By controlling the pressure change, it is possible to eject ink droplets form the nozzle openings 13.

The passage unit 30 is formed by stacking and monolithically bonding constituent members with an adhesive, such as a nozzle forming board 38 (see FIG. 3) having nozzle lines in which the nozzle openings 13 are arranged and a passage forming board 39 forming an ink passage. The passage unit is a unit member forming a series of ink passage (an example of the liquid passage) from a common ink chamber 40 (common liquid chamber) through an ink supply port and the pressure chamber 37 to the nozzle openings 13. The pressure chamber 37 of the passage unit 30 is formed for each nozzle opening 13 and is supplied with ink from the ink pressure control unit 24 through the common ink chamber 40. The passage unit 30 is bonded to the end surface of the head case 28 and the head cover 33 made of metal is attached thereto by the fixing member 33' so as to surround the periphery of the bonded passage unit 30 from the outside. The head cover 33 has a function of protecting the passage unit 30 or the head case 28 and adjusting the nozzle forming board 38 of the passage unit 30 to the ground potential to prevent a problem such as noises due to static electricity generated from a kind of printing sheet as a printing medium.

The driving board 31 has connectors 41 for connection to the FFC 22 and is configured to receive a driving signal from the controller through the FFC 22 and to supply the driving signal to the piezoelectric vibrators 35. Two connectors 41 are disposed at each end. The driving board 31 is connected to the relay board 32 through a flexible cable 42 and is attached to a board fixing unit 25' of the first case 22 to be described later. The relay board 32 is a board for relaying a signal path between the driving board 31 and the piezoelectric vibrators 35 and is disposed on the base end surface (the surface opposite to the surface of the nozzle forming board 38) of the head case 28.

The introduction needle unit 27 as well as the relay board 32 is disposed on the base end surface of the head case 28. The introduction needle unit 27 is shaped of a synthetic resin and plural ink introduction needles 44 liquid introduction needles) are attached to the top surface with a filter 43 interposed therebetween. The top surface of the introduction needle unit 27, that is, the surface opposite to the surface of the nozzle forming board 38 of the head body 5', is provided with a control unit arranging unit 45 for arranging the ink pressure control unit 24. By fitting the ink pressure control unit 24 to the control unit arranging unit 45, the ink introduction needles 44 are inserted into the ink pressure control unit 24. Concentration passages (not shown) corresponding to the respective ink introduction needles 44 are formed on the bottom surface of the introduction needle unit 27. The concentration passage serves as an ink passage for supplying the ink from the ink introduction needles 44 to the pressure chamber 37. When the print head 5 is mounted on the carriage 6, the introduction needle unit 27 is disposed on the carriage 6 and the ink introduction needles 44 are upright from the bottom surface of the carriage 6. The ink introduction needles 44 will be described in detail later.

Figure 4:
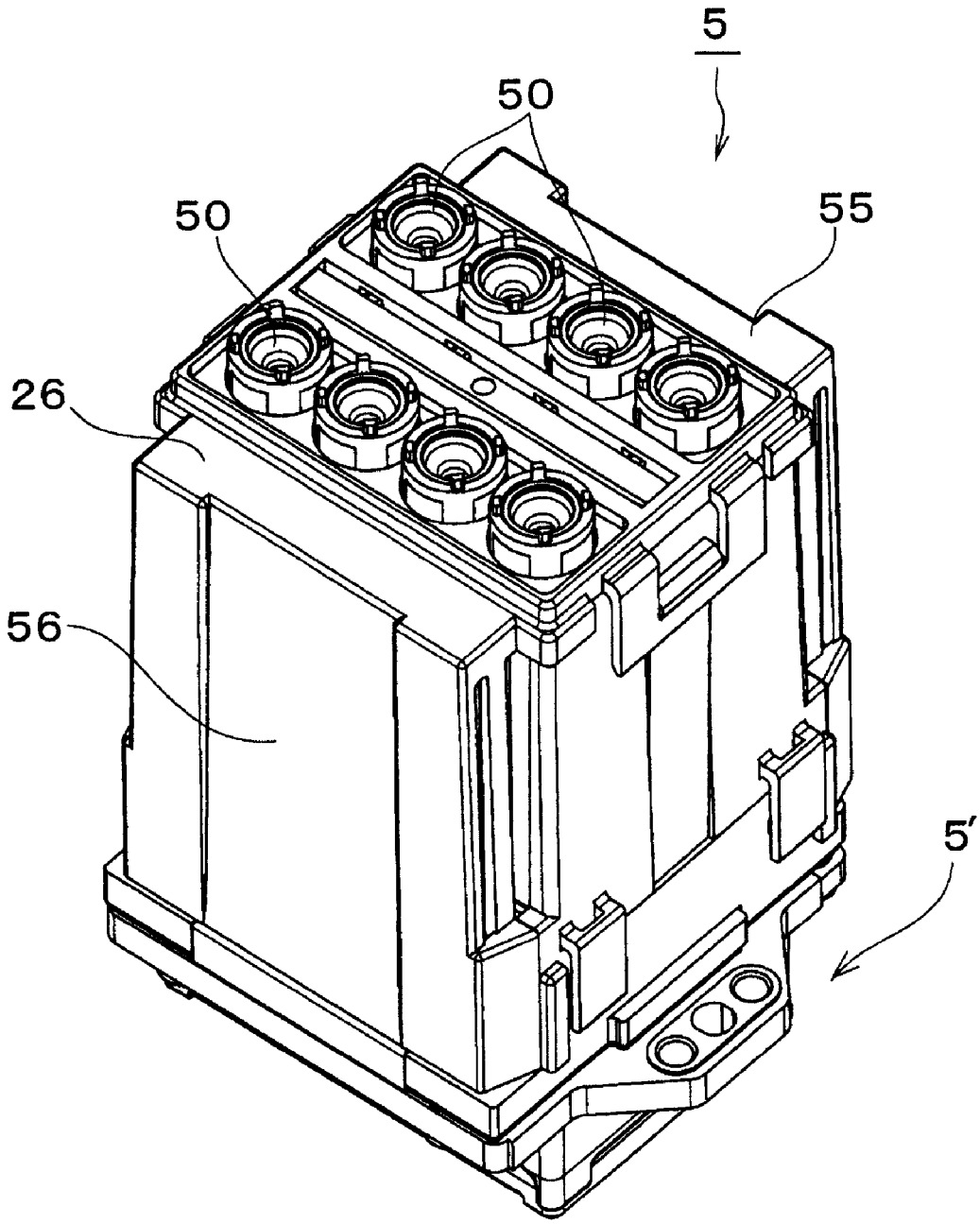
FIG. 4 is a perspective view illustrating the print head.

The ink pressure control unit 24 connected to the ink supply tubes 21 through an attachment 48 (see FIG. 1) connected to the top surface thereof and introduces the ink from the ink supply tubes 21 to the pressure chamber 37 of the print head 5. In this embodiment, as shown in FIGS. 1 and 2, 4 ink pressure control units 24 corresponding to the ink cartridges 17 (colors) or the ink supply tubes 21 are mounted on the control unit arranging unit 45 of the print head 5. The bottoms of the ink pressure control units 24 are provided with introduction needle insertion portions 49 and the ink introduction needles 44 are inserted into the introduction needle insertion portions 49 at the time of mounting the ink pressure control units 24 on the control unit arranging unit 45. On the top surfaces of the ink pressure control units 24, passage connection portions 50 to which the attachment 48 is connected are disposed to protrude upward. Ink distribution passages (not shown) corresponding to the passage connection portions 50 of the ink pressure control units 24 are partitioned in the attachment 48 and thus the ink from the ink supply tubes 21 is distributed and supplied to the ink pressure control units 24 through the ink distribution passages.

The ink pressure control units 24 have a self sealing function of controlling the introduction of ink to the head body 5' pressure chamber 37) of the print head 5 by switching a valve (self sealing valve) depending on the inner pressure change. That is, in a non-printing state (state where ink is not consumed) where the print head 5 does not eject the ink droplets, the ink pressure control units 24 close the valve not to introduce the ink into the head body 5'. On the other hand, when the print head 5 ejects the ink droplets at the time of performing a printing operation (ejecting operation) to consume the ink and thus the inner pressure of an ink pressure control unit 24 is decreased, the ink pressure control unit 24 opens the valve to introduce the ink into the head body 5'. Accordingly, by controlling the ink to be introduced into the head body 5' (pressure chamber 37) as described above, the ink pressure control unit 24 can make the change in ink pressure as small as possible, thereby stabilizing the ejection states of the ink droplets. That is, the ink pressure control units 24 have a function of controlling the pressure of the ink introduced into the pressure chamber 37 of the print head 5.

As shown in FIG. 2, the first case 25 is a sleeve-shaped member of which 4 peripheries are surrounded with 4 side walls and the top and bottom are opened. The plane shape of the openings of the first case 25 is a substantially rectangular shape and the inner space thereof serves as a receiving section 52 for receiving the ink pressure control units 24 arranged on the control unit arranging unit 45. Board fixing portions 25' for fixing the driving board 31 are formed in 2 opposite side walls of the first case 25, respectively.

As shown in FIGS. 2 and 4, the second case 26 is a door-like or "□"-shaped member formed by a base surface 55 of the first case 25 that can cover the top opening of the receiving section 52 and a side wall portion 56 extending downward from both edges of the base surface 55 in a direction perpendicular to the arrangement direction of the ink pressure control units 24. The base surface 55 covers the ink pressure control units 24 exposed from the top opening of the receiving section 52 of the first case 25. The side wall portion 56 covers the driving board 31 fixed to the board fixing portions 25' of the first case 25.

In the base surface 55, exposure openings 57 for exposing the passage connection portions 50 are disposed to correspond to the passage connection portions 50 of the ink pressure control units 24 received in the receiving section 52. In this embodiment, since 2 passage connection portions 50 are disposed in each ink pressure control unit 24, 8 exposure openings 57 corresponding to 4 ink pressure control units 24 are disposed.

Next, a configuration of the ink introduction needles 44 will be described.

Figure 5:
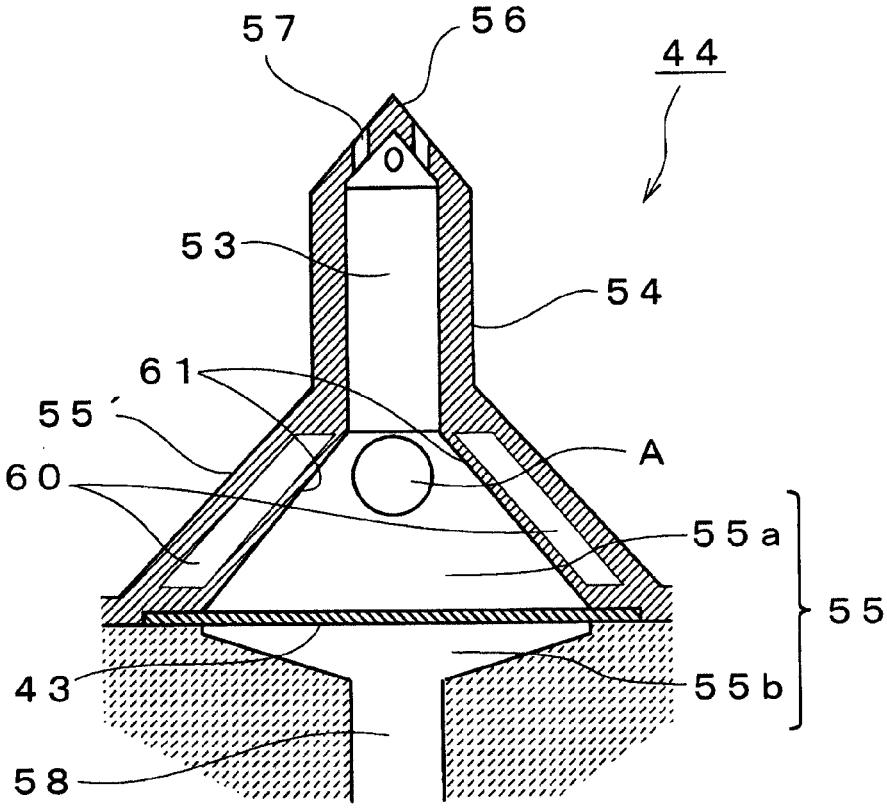
FIG. 5 is a sectional view taken along a longitudinal direction illustrating a configuration of an ink introduction needle according to the embodiment.

As shown in FIG. 5, each ink introduction needle 44 is a hollow needle-shaped member of which the inner space serves as an ink introduction passage 53 (an example of the liquid passage) and roughly includes a straight portion 54 and a filter chamber 55 formed subsequent to the base end of the straight portion 54.

The straight portion 54 is a hollow cylindrical member which is inserted into the introduction needle insertion portion 49 of the ink pressure control unit 24 and a cone-shaped tip portion 56 formed in a taper shape is formed at the end thereof. Plural ink introduction holes 57 allowing the outside of the ink introduction needle 44 to communicate with the ink introduction passage 53 are formed in the tip portion 56. That is, as described above, when the ink introduction needle 44

(straight portion 54) is inserted into the ink pressure control unit 24, the ink supplied to the ink pressure control unit 24 through the ink supply tube 21 from the ink cartridge 17 can be introduced into the ink introduction passage 53 through the ink introduction holes 57. Although it has been described in this embodiment that the ink introduction holes 57 are formed in the tip portion 56, the ink introduction holes 57 may be formed in the side surface of the ink introduction needle 44 downstream of the tip portion 56.

As shown in FIG. 5, the filter chamber 55 is formed in the middle way of the ink introduction passage 53 located downstream of the straight portion 54 by the use of a disc-like filter 43 and includes an upper filter chamber 55*a* in a skirt-like enlarged-diameter portion 55' which is located upstream of the filter 43 and of which the diameter is gradually enlarged from the upstream side (top opening) to the downstream side and a lower filter chamber 55*b* which is located downstream of the filter 43 and of which the diameter is gradually reduced from the upstream side (top opening) to the downstream side (bottom opening). In the lower filter chamber 55*b*, a head passage 58 is formed subsequent to the bottom minimum-diameter portion (bottom opening) of which the diameter is gradually reduced from the inner diameter of the top opening dose to the filter 43. That is, the filter chamber 55 is disposed upstream of the head passage 58 communicating with the common ink chamber 33 pressure chamber 37) and has a diameter greater than those of the other ink passages such as the ink introduction passage 53 of the ink introduction needle 44 or the head passage 58. The area of the top opening of the upper filter chamber 55*a* corresponds to the area of the bottom opening of the straight portion 54 and the area of the bottom opening corresponds to the effective filtering area (area of a region through which the ink can pass in the filter 43) of the filter 43 disposed just below the bottom opening. The area of the top opening of the lower filter chamber 55*b* corresponds to the effective filtering area of the filter 43 disposed just above the top opening and the area of the bottom opening corresponds to the area of the top opening of the head passage 58. Accordingly, the filter chamber 55 is configured to allow the ink from the straight portion 54 to flow to the head passage 38 through the filter 43.

The filter 43 disposed inside the filter chamber 55 has a function of filtering the ink in the ink passage liquid passage). The passage resistance of the ink passage is reduced by making the effective filtering area greater than the sectional area of the other ink passages. In this embodiment, the filter 43 has a function of trapping bubbles in the space (in the upper filter chamber 55*a*) of the filter chamber 55 upstream by making it difficult that the bubbles mixed into the ink passage pass through the filter. Accordingly, the upper filter chamber 55*a* serves as a gas trapping chamber that can trap the gas mixed into the ink in the ink passage.

The ink introduction needle 44 having the above-mentioned configuration is attached to the introduction needle unit 27 by the use of, for example, an ultrasonic welding method, with the bottom opening of the upper filter chamber 55*a* of the filter chamber 55 facing the filter 43. Accordingly, the bottom opening of the upper filter chamber 55*a* and the top opening of the lower filter chamber 55*b* communicate with each other through the filter 43. That is, the ink introduction passage 53 of the ink introduction needle 44 and the head passage 58 dose to the head case 28 communicate with each other liquid-tightly and the ink introduction passage 53 and the head passage 58 serve as the liquid passage in the invention.

In the printer 1 according to this embodiment, gas may enter the ink passage at the time of mounting the ink cartridge 17. The gas is generally melted in the ink degassed in advance, but may become bubbles due to the change in ambient temperature or pressure and thus may float in the ink passage. In the off-carriage type, as described above, since the ink passage from the cartridge 17 to the print head 5 is formed of a relatively long ink supply tube 21, the gas may be mixed through the wall surface of the ink supply tube 21 and melted in the ink in the ink passage, thereby saturating the ink. In this state, since gas newly entering the ink is hardly melted in the saturated ink, the gas floats as the bubbles in the ink passage. The bubbles floating in the ink passage flows downstream with the ink flow due to the printing operation and the like and enters the filter chamber 55 formed in the middle way of the ink passage. Here, the filter 43 according to this embodiment is made to hardly transmit the bubbles, the bubbles are trapped by the filter 43 and stay in the upper filter chamber 55*a*. In the filter chamber 55 according to this embodiment, as described above, since the flow rate of ink gets slow by enlarging the diameter thereof greater than those the other ink passages, the entered bubbles are hardly moved downstream and thus can be made to stay on the upstream side. Accordingly, the bubbles entering the filter chamber 55 from the upstream can be collected and trapped in the space upstream of the filter 43, that is, in the upper filter chamber 55*a*. When the upper filter chamber 55*a* is configured as the gas trapping chamber, it is not necessary to particularly form a gas trapping chamber for trapping and collecting the gas in the ink passage. Since the upper filter chamber 55*a* (ink introduction needle 44) according to this embodiment is disposed on the carriage 6 and in the middle way of the ink passage of the print head 5 closest to the pressure chamber 37, it is possible to satisfactorily trap the bubbles in the ink passage in the vicinity of the pressure chamber 37, thereby reducing the possibility of mixing the bubbles into the pressure chamber 37.

Therefore, in order to prevent a problem due to the gas mixed into the ink, in the printer 1 according to this embodiment, a gas collecting chamber 60 is formed outside the upper filter chamber 55*a* by a partition wall inside the skirt-like enlarged-diameter portion 55' defining the upper filter chamber 55*a*, the partition wall between the upper filter chamber 55*a* and the gas collecting chamber 60 is formed of a permeable partition wall 61 which gas can permeate, the pressure in the gas collecting chamber 60 is made smaller than the pressure of the upper filter chamber 55*a* by a pressure difference applying unit, and the gas (bubbles A) trapped in the upper filter chamber 55*a* is collected in the gas collecting chamber 60 through the permeable partition wall 61, as shown in FIG. 5.

The permeable partition wall 61 of the upper filter chamber 55*a* is monolithically formed of the same gas permeable material as the other partition walls defining the upper filter chamber 55*a* and the straight portion 54, such as POM (polyacetal), PP (polypropylene), and PPE (polyphenylene ether) and has a thickness smaller than that of the other partition walls or the portion of the partition wall of the straight portion 54 in contact with external air. That is, the permeable partition wall 61 is formed by reducing the thickness of at least a part of the partition wall defining the upper filter chamber 55*a*. In other words, the permeable partition wall 61 is formed of a part of a structure forming the liquid passage. Accordingly, it is possible to omit a process of particularly shaping and attaching the permeable partition wall 61 and to enhance the gas permeability in comparison with the other partition walls. In this embodiment, when the area of the permeable partition wall 61 is about 1 $cm^2$ and the thickness thereof is about 1 mm, it can be seen from the test result that the permeability is proper. Any other material may be used so long as the material satisfies a condition that the gas permeable coefficient is 5 cc·mm/m$^2$·day·atm or more and the moisture permeable coefficient is 2 g·mm/m$^2$·day·atm or less. The permeable partition wall 61 may be formed of a material having the gas permeability greater than those of the other partition walls defining the upper filter chamber 55*a*.

The gas collecting chamber 60 is a ring-shaped space surrounded with the permeable partition wall 61 and the outer peripheral partition wall of the skirt-like enlarged-diameter portion 55' and communicates with the pressure difference applying unit to be described later through a suction path 63 (see FIG. 6). The gas collecting chamber 60 need not surround the entire upper filter chamber 55*a*, but may surround a part of the upper filter chamber 55*a*. In brief, the gas collecting chamber may have any shape so long as it can has a gas collecting space located outside the upper filter chamber 55*a* and can be formed with the permeable partition wall 61 interposed therebetween.

Next, the pressure difference applying chamber for reducing the pressure of the gas collecting chamber 60 to be smaller than the pressure of the upper filter chamber 55*a* will be described.

The pressure difference applying unit according to this embodiment includes a depressurizing unit for reducing the pressure of the gas collecting chamber 60 to be smaller than the pressure of the upper filter chamber 55*a*. As shown in FIG. 6, the depressurizing unit may be configured to depressurize the gas collecting chamber 60 by the use of the cleaning-operation pump unit 14, by connecting the suction path 63 communicating with the gas collecting chamber 60 in parallel to a cap suction path 64 for depressurizing the cap member 12'.

Figure 6:
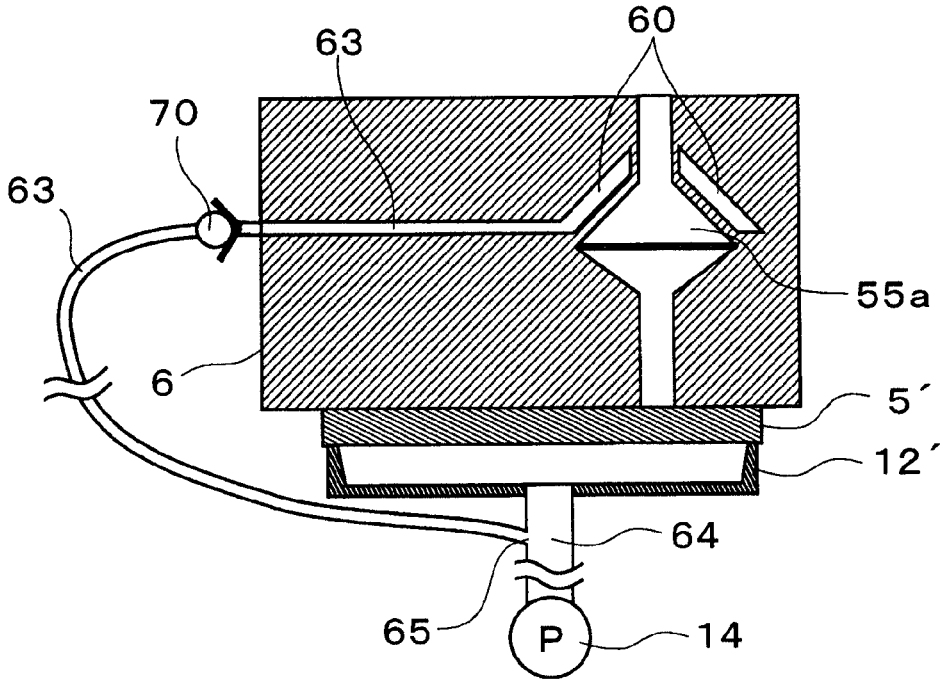
FIG. 6 is a schematic diagram illustrating a depressurizing unit as a pressure difference applying unit according to the embodiment.

As shown in FIG. 6, the depressurizing unit includes a pump unit 14 for depressurizing the gas collecting chamber 60 through the suction path 63 from the gas collecting chamber 60 and a check valve 70 that is disposed in the middle way of the suction path 63 and that serves to permit the passing of gas from the gas collecting chamber 60 to the pump unit 14 and to inhibit the reverse passing. The suction path 63 is connected to the cap suction path 64 through a branch connection portion 65 and the suction path between the branch connection portion 65 and the carriage 6 is formed of a flexible hollow tube member.

According to this configuration, by activating the pump unit 14 to suck and depressurize the cap suction path 64, it is possible to depressurize the gas collecting chamber 60 through the branched suction path 63. Accordingly, it is possible make the pressure of the gas collecting chamber 60 smaller than the pressure of the upper filter chamber 55*a*. By the use of this pressure difference, it is possible to collect the bubbles trapped in the upper filter chamber 55*a* in the gas collecting chamber 60 through the permeable partition wall 61. Since the upper filter chamber 55*a* serves as the gas trapping chamber, the bubbles floating in the ink passage can be satisfactorily trapped in the space upstream of the filter 43 and the trapped bubbles can be collected in the gas collecting chamber 60. Accordingly, it is possible to prevent a problem resulting from the entrance of bubbles to the pressure chamber 37 in advance. In addition, since the frequency of the cleaning operation for discharging the bubbles can be reduced less than that in the past, it is possible to reduce the ink consumption accompanied with the cleaning operation.

When the gas collecting chamber 60 is depressurized by the use of the pump unit 14 generally used for the cleaning operation, it is not necessary to particularly provide the depressurizing unit. Since the gas collecting chamber 60 can be depressurized as the same time as the cleaning operation, the suction for depressurizing only the gas collecting chamber 60 need not be performed individually. Since the suction path 63 between the branch connection portion 65 to the cap suction path 64 and the carriage 6 is formed of a tube member, the movement of the carriage 6 is not restricted.

In the pressure difference applying unit, since the gas in the gas collecting chamber 60 flows only in the depressurizing direction by disposing the check valve 70 in the middle way of the suction path 63, it is possible to maintain the gas collecting chamber 60 in a negative pressure state. Since the check valve 70 is opened only at the time of activating the depressurizing unit, it normally maintains the closed state. For this reason, the check valve 70 also serves as a pressure difference maintaining unit that can maintain the pressure difference between the upper filter chamber 55*a* and the gas collecting chamber 60, regardless of the activation or deactivation of the apparatus.

In this way, it is possible to maintain the pressure difference between the gas collecting chamber 60 and the upper filter chamber 55*a* for a long time. Accordingly, even when the pressure difference is not greater than that in the past, it is possible to slowly collect the bubbles in the upper filter chamber 55*a*. Accordingly, it is possible to suppress the permeation of ink or the deformation in the permeable partition wall 61 resulting from a large pressure difference. Therefore, it is possible to prevent the problems such as a decrease in gas permeability resulting from the permeation of ink.

By constructing the pressure difference applying unit as described above, it is possible to easily control the magnitude of the pressure supplied to the gas collecting chamber 60 by appropriately setting the threshold value of the pressure for opening the check valve 70 or setting the suction time of the pump unit 14. Since the ink pressure in the upper filter chamber 55*a* can be constantly controlled by the ink pressure control unit 24, the pressure difference applying unit can properly set the pressure difference between the gas collecting chamber 60 and the upper filter chamber 55*a* by controlling the pressure in the gas collecting chamber 60. In this embodiment, it is preferable that the pressure difference is set to be equal to or greater than the saturated steam pressure at the ambient temperature of the upper filter chamber 55*a*. Specifically, the pressure difference may be set to be 10 kPa or more.

In this embodiment, the volume decrease rate at which the volume of the bubbles trapped in the upper filter chamber 55*a* is decreased due to the collection of the bubbles in the gas collecting chamber 60 is set to be greater than the volume increase rate at which the volume of the gas trapped in the upper filter chamber 55*a* is increased due to the combination of the gas with the bubbles coming from the upstream side of the ink passage. Specifically, it is set that the gas permeating quantity per 24 hours (1 day) of the partition wall is, for example, 0.05 mm$^3$/day or more and the steam permeating quantity is 0.10 mg/day or less, by controlling the balance among the pressure difference P (for example, about 10 kPa), the area S of the permeable partition wall permeable area) (for example, about 1 cm$^2$), the thickness T (for example, about 1 mm), the gas permeating coefficient K of the material (for example, about 5 cc·mm/m$^2$·day·atm or more) or the steam permeating coefficient k of the material (for example, about 2 g·mm/m$^2$·day·atm or less). The balance is not limited to the above-mentioned numerical values, but may be properly set on the basis of the expression of "permeating quantity$\propto$S·K (or k)·P/T".

According to this setting, since it is possible to suppress the increase in volume of the bubbles of the upper filter chamber 55*a* up to the volume causing a problem and thus to reduce the possibility of mixing the bubbles into the pressure chamber 37, the possibility of causing a problem due to the entrance of the bubble into the pressure chamber 37 is removed.

Although the pressure difference maintaining unit including the depressurizing unit for depressurizing the gas collecting chamber 60 has been described in this embodiment, the invention is not limited to it. For example, the upper filter chamber 55*a* as the gas trapping chamber may be pressurized by a pressurizing unit for pressurizing the ink passage. Specifically, the gas collecting chamber 60 and the upper filter chamber 55*a* may be formed in the same way as the above-mentioned embodiment, an atmospheric air opening path allowing the gas collecting chamber 60 to communicate with the external air may be provided, the air pump 20 for pressurizing and supplying the ink in the cartridge 17 may be used as the pressurizing unit, and the plate-like nozzle sealing member made of an elastic member that can seal all the nozzle openings 17 may be disposed in the non-printing area of the home position or the opposite position (all are not shown). Accordingly, in the state where the nozzle openings 13 are sealed by the nozzle sealing member, by activating the air pump 20 to pressurize the ink passage between the cartridge 13 and the nozzle openings to be greater than the atmospheric pressure, it is possible to make the pressure of the gas collecting chamber 60 smaller than the pressure of the upper filter chamber 55*a*. By the use of the pressure difference caused by the pressurizing unit, it is possible to collect the gas of the upper filter chamber 55*a* in the gas collecting chamber 60 and to discharge the collected gas to the outside through an atmospheric air opening path. When the pressure from the air pump 20 is applied to the ink passage and the nozzle openings 13 are sealed by the nozzle sealing member at the time of deactivation, it is possible to maintain the pressure difference between the pressure of the gas collecting chamber 60 and the pressure of the upper filter chamber 55*a*. Accordingly, the nozzle sealing member may serve as the pressure difference maintaining unit for maintaining the pressure difference. It is preferable that the pressurization from the air pump 20 as the pressure difference applying unit is set to the range of pressure in which the permeable partition wall 61 does not cause a problem such as the permeation of ink.

In this embodiment, when the ink in the ink passage is pressurized by the pressurizing unit, the nozzle openings 13 are sealed by the nozzle sealing member, but the invention is not limited to this configuration. That is, any configuration may be employed so long as the ink in the upper filter chamber 55*a* upstream can be pressurized by closing the ink passage downstream of the filter chamber 55. For example, in the above-mentioned embodiments, the ink pressure control units 24 disposed upstream of the filter chamber 55 may be disposed downstream of the filter chamber 55 and the ink passage downstream of the filter chamber 55 may be closed by a valve (self sealing valve) disposed in the ink pressure control units 24, thereby pressurizing the filter chamber 55.

Figure 7:
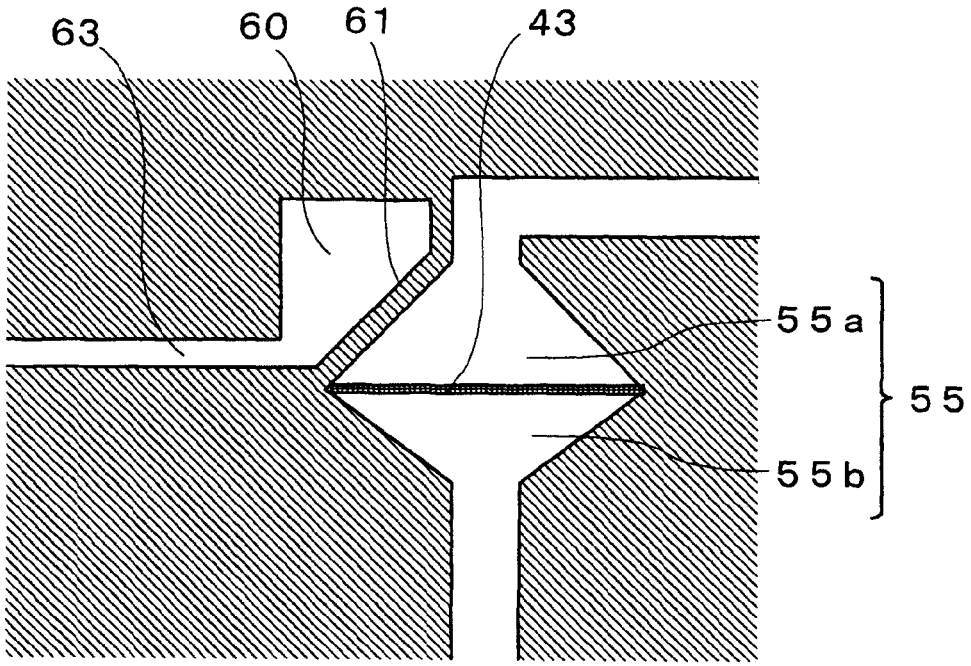
FIG. 7 is a sectional view illustrating a filter chamber and a gas collecting chamber according to another embodiment of the invention.
Figure 8:
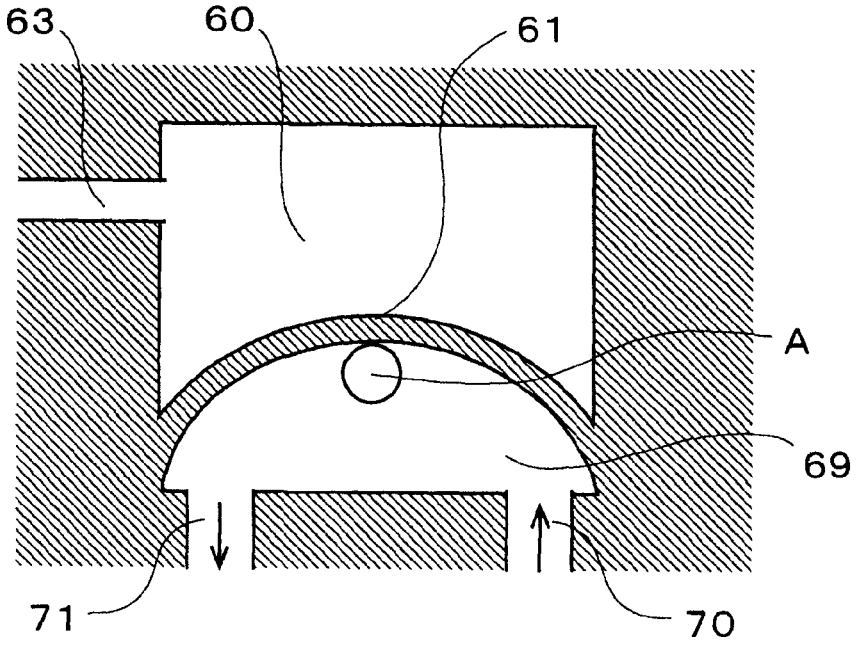
FIG. 8 is a sectional view illustrating a gas trapping chamber and a gas collecting chamber according to another embodiment of the invention.

In the above-mentioned embodiments, the upper filter chamber 55*a* formed monolithically in the ink introduction needle 44 is used as the gas trapping chamber for trapping the bubbles in the ink passage, but the invention is not limited to the configuration. That is, any configuration may be employed so long as it is formed in the middle way of the ink passage and can trap the bubbles. For example, as shown in FIG. 7, the same filter chamber 55 as the above-mentioned embodiments may be formed in the middle way of the ink passage and the upper filter chamber 55*a* may be used as the gas trapping chamber. The gas trapping chamber is not limited to the filter chamber 55, but may be constructed by a space for trapping the bubbles using the buoyancy. Specifically, as shown in FIG. 8, a dome-like trap chamber 69 having a width greater than those of the other portions may be formed in the middle way of the ink passage, an entrance passage 70 may be formed on one side of the floor surface of the trap chamber 69, an exit passage 71 may be formed on the opposite sides and the gas collecting chamber 60 may be formed above the trap chamber with the permeable partition wall 61 serving as the dome-like ceiling of the trap chamber 69 therebetween. According to this configuration, the bubbles A included in the ink passing through the entrance passage 70 and the exit passage 71 float with the buoyancy and contact with and stay on the bottom surface of the dome-like permeable partition wall 61. Since the trap chamber 69 has a width greater than those of the other ink passage, the flow rate of the ink is slowed and the bubbles A floating above hardly flow to the exit passage 71 below. Accordingly, the bubbles A can be easily trapped in the upper portion of the trap chamber 69.

Figure 9:
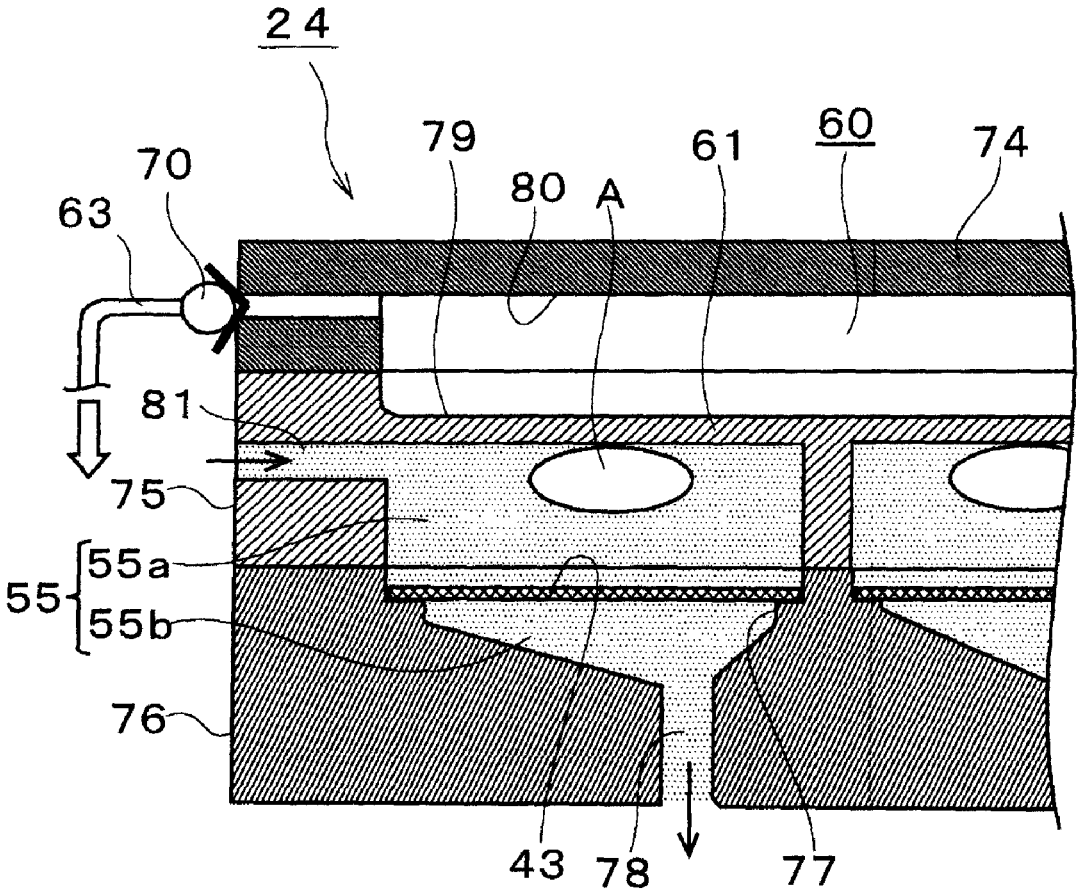
FIG. 9 is a sectional view illustrating an ink pressure control unit according to another embodiment of the invention.

FIG. 9 is a diagram illustrating a configuration according to another embodiment of the invention and a sectional view illustrating a part of the ink pressure control unit 24 as a member forming the liquid passage in the invention. In the drawing, the downstream configuration is enlarged more than that of the self sealing valve.

In this embodiment, a gas collecting chamber 60 is disposed in an ink pressure control unit 24. The ink pressure control unit 24 is formed by stacking plural structures. In this embodiment, the ink pressure control unit includes three structures in total of a first structure 74 for defining the gas collecting chamber 60, a second structure 75 for defining the upper filter chamber 55*a*, and a third structure 76 for defining the lower filter chamber 55*b* from the upside in FIG. 9.

The bonding surface of the third structure 76 to the second structure 75 is depressed to the opposite side in a mortar shape or a funnel shape to form the lower filter chamber 55*b* and a communication passage 78 communicating with the print head 5 is formed subsequent to the downstream end of the lower filter chamber 55*b*. At a position slightly downstream of the upstream opening of the lower filter chamber 55*b*, a stepped portion 77 protruding to the diameter center in a step shape in a section is formed along the entire circumference of the upstream opening of the lower filter chamber 55*b*. The filter 43 is attached by bonding the peripheral edge of the bottom surface of the filter 43 to the top surface of the stepped portion 77 by the use of an ultrasonic welding method.

In the bonding surface of the second structure 75 to the third structure 76, the portion corresponding to the lower filter chamber 55*b* of the third structure 76 is depressed toward the opposite surface (the bonding surface to the first structure 74) in a rectangular sectional shape to form the upper filter chamber 55*a*. The opening shape of the upper filter chamber 55*a* corresponds to the upstream opening shape of the lower filter chamber 55*b*. By stacking the second structure 75 and the third structure 76, the upper filter chamber 55*a* and the lower filter chamber 55*b* communicate with each other, thereby forming the filter chamber 55.

An introduction path 81 for introducing ink from the self sealing valve not shown into the upper filter chamber 55*a* is formed in the second structure 75. By depressing the bonding surface of the second structure 75 to the first structure 74 toward the upper filter chamber 55*a* to form a depressed portion 79, the thickness of the boundary wall with the upper filter chamber 55*a* becomes smaller. The boundary wall serves as the permeable partition wall 61. That is, the permeable partition wall 61 is formed by a part of a structure forming the liquid passage.

It is preferable that the permeable partition wall 61 is formed of a rigid wall having such a thickness that makes the gas exchange, that is, the permeation of gas, possible due to the pressure difference between the filter chamber 55 (upper filter chamber 55*a*) and the gas collecting chamber 60 while securing the rigidity for maintaining the shape even when the pressure is changed at least by the pressure difference applying unit. Specifically, the thickness of the permeable partition wall 61 is set to the range of 10% to 50% of the average thickness of the other portions. The second structure 75 including the permeable partition wall 61 is formed of a material having higher gas permeability than that of the material of the other structures 74 and 76. Specifically, plastics such as m-PPE (denaturalized polyphenylene ether) and PP (polypropylene) or alloys thereof can be employed. On the other hand, it is preferable that the other structures 74 and 76 are formed of a material having low gas permeability such as PPS (polyphenylene sulfide), m-PPE/PPS alloy (alloy of denaturalized polyphenylene ether and polyphenylene sulfide), liquid crystal polymer, and EVOH (ethylene-vinyl alcohol copolymer resin). Accordingly, it is possible to secure the gas permeability of the permeable partition wall 61 and to secure the air-tightness of the other partition walls. As a result, it is possible to efficiently remove the gas in the gas trapping chamber (upper filter chamber 55*a*). Of course, the materials of the structures 74, 75, and 76 may be equal to each other.

The bonding surface of the second structure 75 to the first structure 74 is depressed to the opposite side to form a depressed portion 80 in the first structure 74. The opening shape of the depressed portion 80 corresponds to the opening shape of the depressed portion 79 of the second structure 75. By stacking the first structure 74 and the second structure 75, the depressed portion 79 and the depressed portion 80 communicate with each other to form the gas collecting chamber 60. The gas collecting chamber 60 according to this embodiment is an empty portion common to the filter chambers 55 formed in the plural ink passages, respectively. The gas collecting chamber 60 is disposed to be adjacent to the upper filter chamber 55*a* with the permeable partition wall 61 interposed therebetween. The gas collecting chamber 60 is connected to the depressurizing means (pressure difference applying unit) such as the pump unit 14 through the check valve 70 and the suction path 63.

In the above-mentioned configuration, when the pump unit 14 is activated to depressurize the gas collecting chamber 60, it is possible to make the pressure of the gas collecting chamber 60 smaller than the pressure of the upper filter chamber 55*a*. At this time, it is preferable that the pressure difference is set to be greater than or equal to the saturated steam pressure at the ambient temperature of the upper filter chamber 55*a*. Specifically, the pressure difference is set to the range of 5 kPa to 30 kPa. The bubbles A trapped in the upper filter chamber 55*a* can be collected in the gas collecting chamber 60 through the permeable partition wall 61 by means of the pressure difference. That is, in this embodiment, it is possible to obtain the same operational advantages as the above-mentioned embodiments. When the pressure difference is 5 kPa or less for a long time, the same operational advantages can be obtained. Accordingly, the pressure difference should be greater than 0 kPa.

In this embodiment, the second structure 75 including the permeable partition wall 61 is formed of the material different from the materials of the other structures 74 and 76 defining the liquid passage and the material having high gas permeability than that of the other structures, but the invention is not limited to the example. The structures 74, 75, and 76 may constitute a monolithic member. That is, as in the first embodiment, the configuration may be employed in which the permeable partition wall 61 is monolithically formed of the same material as the structure defining the liquid passage so as to be thinner than the portion (partition wall) contacting with the external air.

In the above-mentioned embodiments, since the permeable partition wall 61 is used as a part of the structures defining the liquid passage and the rigidity of the permeable partition wall 61 is enhanced in comparison with the past configuration using the gas permeable film made of silicon or the like, it is possible to prevent the deformation or damage of the permeable partition wall 61 when the pressure difference is caused by the pressure difference applying unit. It is also possible to prevent the careless ejection of ink resulting from the warping of the permeable partition wall 61 due to the pressure change from the pressure difference applying unit. Since the deformation of the permeable partition wall 61 is suppressed, it is possible to suppress the pressure loss at the time of ejecting the ink from the nozzle openings 13 of the print head 5. In addition, the supporting pillars (supporting member) for securing the rigidity in the past configuration is not necessary.

In the above-mentioned embodiments, the invention is applied to the printer 1 which is a kind of an off-carriage type liquid ejecting apparatus, but the invention may be applied to an on-carriage type liquid ejecting apparatus. That is, the invention can be applied to a configuration in which the ink cartridges 17 instead of the ink pressure control units 24 are received in the receiving section of the carriage 6.

In this case, it is preferable that the gas trapping chamber and the gas collecting chamber are disposed in the ink introduction needles.

The invention is not limited to the printer 1, but may be applied to liquid ejecting apparatuses such as a display manufacturing apparatus, an electrode forming apparatus, a chip manufacturing apparatus, and a micro pipette, so long as they have a configuration for introducing liquid reserved in a liquid reservoir into a liquid ejecting head through a liquid passage.

What is claimed is:

1. A liquid ejecting apparatus including a liquid ejecting head which has a pressure chamber into which liquid flows from a liquid reservoir through a liquid passage, and a pressure generating unit operable to pressurize the liquid in the pressure chamber to eject the liquid through a nozzle opening, the liquid ejecting apparatus comprising:

a gas trapping chamber formed in the liquid passage and adapted to trap gas mixed in the liquid;

a gas collecting chamber formed adjacent to the gas trapping chamber;

a gas permeable wall interposed between the gas trapping chamber and the gas collecting chamber; and a pressure difference generating unit operable to generate a pressure difference between the gas trapping chamber and the gas collecting chamber so that a pressure in the gas collecting chamber is lower than a pressure in the gas trapping chamber, thereby collecting the gas trapped in the gas trapping chamber in the gas collecting chamber through the gas permeable wall, wherein the gas permeable wall is a part of a structure forming the liquid passage, wherein the gas permeable wall is monolithically integrated with the structure forming the liquid passage;

wherein the liquid passage is defined by a partition wall in the structure, a part of which is exposed to ambient air; and wherein a thickness of the gas permeable wall is thinner than a thickness of the exposed part of the partition wall.

2. A liquid ejecting apparatus including a liquid ejecting head which has a pressure chamber into which liquid flows from a liquid reservoir through a liquid passage, and a pressure generating unit operable to pressurize the liquid in the pressure chamber to eject the liquid through a nozzle opening, the liquid ejecting apparatus comprising:

a gas trapping chamber formed in the liquid passage and adapted to trap gas mixed in the liquid;

a gas collecting chamber formed adjacent to the gas trapping chamber;

a gas permeable wall interposed between the gas trapping chamber and the gas collecting chamber;

a pressure difference generating unit operable to generate a pressure difference between the gas trapping chamber and the gas collecting chamber so that a pressure in the gas collecting chamber is lower than a pressure in the gas trapping chamber, thereby collecting the gas trapped in the gas trapping chamber in the gas collecting chamber through the gas permeable wall, the pressure difference generating unit being operable to decrease the pressure in the gas collecting chamber lower than the pressure in the gas trapping chamber;

a sealing member adapted to seal the nozzle opening of the liquid ejecting head; and a suction pump connected to the sealing member through a first suction passage and operable to depressurize the nozzle opening, wherein the pressure difference generating unit includes a second suction passage connecting the gas collecting chamber to the first suction passage.

* * * * *